US006026665A

United States Patent [19]

Raybary

[11] Patent Number: 6,026,665

[45] Date of Patent: Feb. 22, 2000

[54] DOOR LOCK COMBINATION CHAMBERS

[75] Inventor: Paul Raybary, Winston Salem, N.C.

[73] Assignee: Ilco Unican Corporation, Winston-Salam, N.C.

[21] Appl. No.: 09/052,553

[22] Filed: Mar. 31, 1998

[51] Int. Cl.[7] ..... E05B 13/10; E05B 37/02

[52] U.S. Cl. ..... 70/214; 70/305; 70/306

[58] Field of Search ..... 70/119, 133, 138, 70/213, 214, 219, 314, 313, 304, 305, 306

[56] References Cited

U.S. PATENT DOCUMENTS

| | | | |
|---|---|---|---|
| 3,040,556 | 6/1962 | Rosenhagen | 70/306 |
| 3,115,765 | 12/1963 | Fengler . | |
| 3,832,873 | 9/1974 | Barnette | 70/305 |
| 4,732,020 | 3/1988 | Pieddeloup | 70/305 |
| 4,848,116 | 7/1989 | Lizotte | 70/306 |
| 5,007,262 | 4/1991 | Nakai | 70/306 |
| 5,058,404 | 10/1991 | Fish et al. . | |

*Primary Examiner*—Darnell M. Boucher
*Attorney, Agent, or Firm*—Hill & Simpson

[57] ABSTRACT

The present invention provides new door lock combination chambers for use with door locks, particularly pushbutton door locks. The combination chamber includes rotary keys which are actuated by pressing pushbuttons when entering an unlocking code into the combination chamber. The rotary keys rotate and engage idler gears which are engaged with a timing gear and code gears. The code gears have pockets which become aligned with an unlocking slide when the proper unlocking combination is entered into the combination chamber. The unlocking slide can be slide into the pockets on the code gears, and thus allow a corresponding locking mechanism retract a latch bolt in a door.

22 Claims, 13 Drawing Sheets

DOOR LOCK COMBINATION CHAMBERS

FIELD OF THE INVENTION

The present invention generally relates to door locks, and more specifically, the present invention relates to door lock combination chambers for use with pushbutton door locks.

BACKGROUND OF THE INVENTION

Door locks are commonly used to lock doors and restrict access or passage through the doors. Door locks may provide restricted entry through one or both sides of the door. Door locks typically lock only one side of the door while permitting unrestricted access through the other side of the door. However, it may be desirable to lock both sides of the door for some door lock applications. Examples of door locks include key entry, combination dial locks, electronic locks, pushbutton locks and various other locks.

Pushbutton locks are access control devices which are typically fully mechanical locks having mechanical pushbuttons for entering a combination to unlock the lock. Pushbutton locks operate when the correct buttons are pushed in the proper sequence and a turn knob is rotated. Pressing the correct buttons in the proper sequence enters an unlocking code into the pushbutton lock to permit the turn knob to open a door latch when the turn knob is rotated. The unlocking code or combination of the pushbutton locks can be modified as desired.

Pushbutton locks can provide advantages over other types of locks. For example, pushbutton locks do not require a key which can be duplicated or lost. Also, mechanical pushbutton locks do not require an electronic system to operate the lock or a power source for the electronic system, such as a battery.

Mechanical pushbutton locks have been used in a variety of applications. For example, mechanical pushbutton locks have been used to provide access control for public buildings, commercial buildings, industrial buildings and residential buildings. One type of application for pushbutton locks is a glass door having a stile which contains the glass. The pushbutton lock is mounted on the stile. However, door stiles for glass doors have become narrower. Accordingly, existing pushbutton locks may not be suitable for glass doors having a narrow stile.

Existing pushbutton locks have included a turn knob which is manually rotated after the proper code is entered via the pushbuttons to unlatch the lock. A turn knob may not be suitable for use as a handle to open the door once the latch is unlatched. Also, the latching mechanism requires rotational drive from rotational movement of the turn knob to unlatch the latch. Rotational drive of the door latch may not be suitable for all door lock applications.

Existing pushbutton door locks have included a rotational handle in place of the rotatable turn knob. The rotatable handles rotate similarly to the turn knob but may also be used to open the door once the pushbutton lock is unlocked. The rotatable door handles require two movements by the operator to open the door after the proper unlocking code has been entered through the pushbuttons. The door handle is first rotated in a plane parallel to the face of the door to retract the door latch into the door stile. Subsequently, the person opening the door must pull or push the door handle perpendicularly relative to the face of the door. Accordingly, pushbutton door locks can be improved.

It would be advantageous to improve existing pushbutton door locks by providing pushbutton door locks having a narrow width suitable for use with glass doors having a narrow door stile. It would also be advantageous to improve existing pushbutton door locks by eliminating the rotational drive of the turn knob or door handle to retract the door latch. Existing pushbutton door locks could be further improved by providing mechanisms which simplify opening the door, such as retracting the door latch and opening the door with a single movement of the door handle after the proper unlocking combination has been entered through the pushbuttons.

Existing pushbutton door locks have included a combination chamber which can be set to a specific unlocking code or combination. The unlocking code is entered into the combination chamber by pushing the correct buttons in proper sequence. However, existing combination chambers have been relatively complex and have required numerous parts. Existing combination chambers for pushbutton locks have been relatively large which results in a relatively large overall size of the pushbutton lock. For example, the pushbutton locks may be too wide for doors having narrow door stiles and may also extend to far outward from the face of the door. Existing pushbutton door locks which extend outward from the door face a relatively great distance may be said to have a "high profile." High profile door locks may not be suitable for all applications. For example, such high profile door locks may interfere with an additional door, such as a storm door, which may be positioned relatively close to the door containing the pushbutton lock.

Accordingly, it would be advantageous to improve pushbutton door locks by providing new pushbutton door locks having low profiles. It would also be advantageous to improve pushbutton door locks by providing new combination chambers which are simplified, easier to manufacture, less costly and which have relatively smaller sizes. Other advantages for having new pushbutton door locks will become apparent in view of the present invention.

SUMMARY OF THE INVENTION

The present invention provides new pushbutton door locks for use in providing access control, such as pushbutton paddle door locks controlling access through doors. The present invention also provides new door lock combination chambers for use with pushbutton door locks. One specific application for the new pushbutton door locks is for use with glass doors having a narrow stile; however, the new pushbutton locks can be used for various types of access control applications. The pushbutton locks of the present invention may be used for public buildings, commercial applications, residential applications, industrial applications and various other types of applications where access control is desired, for example.

The pushbutton door locks of the present invention may have a relatively narrow width, which permits the pushbutton door locks to be used with doors having narrow stiles such as glass doors with narrow aluminum stiles. The pushbutton paddle locks have an outside paddle which moves in a single motion to unlatch and open the door after the proper unlocking combination is entered through the pushbuttons and a go button is depressed. Also, the driving mechanism of the new pushbutton locks which retracts the latch bolt has a linear sliding actuation rather than a rotational drive.

The new door lock combination chambers of the present invention have a relatively small size which permits the pushbutton locks to have a "low profile." In other words, the new door lock combination chambers extend a relatively short distance perpendicularly outward from the face of the door. The new door lock combination chambers also have a simplified structure which reduces the number of components of the combination chamber, while maintaining access control, security and reliability of the pushbutton door locks. Other advantages of the new door lock combination chambers over existing pushbutton combination chambers can be realized with reference to U.S. Pat. No. 3,115,765 titled Permutation Lock.

One new door lock combination chamber according to the present invention is an improvement because it combines a rotary key and a stem key into one rotary key, eliminates a rotary key shaft, realigns gear meshing in order to make the unit relatively flat, eliminates a code gear separator, eliminates an idler gear separator, redesigns the code gears, redesigns the back side of the idler gears, redesigns the timing gear so it will serve also as a rotary key shaft, eliminates a detent mechanism for indexing the timing gear and uses a standard ball plunger instead, eliminates a control shaft unit, redesigns top and bottom end plates to make the unit more serviceable, and reduces the projection height of the unit, for example to about ⅜".

The new pushbutton door locks and door combination chambers of the present invention may be access control devices which are completely mechanical, i.e. include no electrical components. However, it is contemplated that the present invention could include electronic components if desired. The all-mechanical pushbutton locks and combination chambers of the present invention are ruggedly constructed and offer the dependability of keyless access control for a wide and continually expanding range of applications. Features of the present invention may include no unlocking keys or cards, no wiring or electrical components, all mechanical components which are not effected by power failures, a high degree of security because the locks cannot be picked, rugged, whether-resistant and all-metal construction, one handed operation, large easy-to-depress pushbuttons, ability to change the unlocking code or combination, and the ability to be used in a variety of applications. The new pushbutton door locks and door lock combination chambers may have up to five pushbuttons which can provide thousands of different unlocking combinations. However, the present invention contemplates using more or less than five pushbuttons. The pushbutton door locks may include outside and inside paddles for opening a door from either side of the door. The outside paddle may provide controlled access through the door via the combination chamber while the inside paddle may provide uncontrolled access through the door. A latch hold back feature may also be provided, such as on the inside uncontrolled access of the door, to maintain the door lock in an unlocked condition as desired. It is also contemplated to include a key access to override the combination chamber if desired.

One pushbutton door lock according to the present invention has a lock combination unit, an operator actuator, a door latch bolt, a latch bolt retracting mechanism, and a moveable door handle. The lock combination unit has a locked position prior to entry of an unlocking combination, and an unlocked position when an unlock combination is entered into the lock combination unit. The operator actuator is engaged with the combination unit. The latch bolt retracting mechanism has a first portion engaged with the operator actuator and a second portion engaged with the door latch bolt. The first and second portions of the retracting mechanism are alternately disengaged and engaged with each other when the unlocking combination is entered into the combination unit and the operator actuator is actuated. The moveable door handle is engaged with the first portion of the retracting mechanism and is linked to the door latch bolt by the engaged first and second portions of the engagement mechanism. The door handle has an actuated position which actuates the engaged first and second portions of the retracting mechanism to unlock positions. The door latch bolt is in the retracted position when the second portion of the engagement mechanism is in the unlocked position.

The first portion of the retracting mechanism may include an actuation button engaged with the operator actuator and a rotatable rotor in contact with the actuation button and the door handle. The second portion of the retracting mechanism may include a driver lever engaged with the rotor when the first and second portions of the retracting mechanism are engaged and a latch driver engaged with the driver lever and the latch bolt. The operator actuator may be a spring loaded button which includes a pivotable chamber actuator in contact with an unlocking slide of the combination unit and a pivotable rotor actuator in contact with the actuation button. The latch driver may slide linearly when actuated by the driver lever.

An inside door handle linked to the door latch may also be provided to open the door without entering the combination into the combination unit. A latch open holding pin selectively engageable with the inside lever may also be provided to maintain the latch bolt in a retracted position. The door lock may also include a reset link in contact with a lock combination reset mechanism of the combination unit and the door handle.

One lock combination chamber according to the present invention includes a rotatable timing gear, a plurality of rotary keys, an idler gear shaft, a code gear shaft, and an unlocking slide. The rotatable timing gear has a plurality of gear sections. The rotary keys are mounted on the timing gear and are rotatable relative to the timing gear. Each one of the rotary keys is associated with one of the gear sections of the timing gear. The idler gear shaft has a plurality of rotatable idler gears in which each one of the idler gears is engaged with one of the gear sections of the timing gear after rotation of the idler gear by contact with one of the rotary keys rotating on the timing gear. The code gear shaft has a plurality of rotatable code gears in which each one of the code gears is engaged with one of the idler gears and defines a pocket. The unlocking slide has a plurality of legs inserted into pockets of the code gears when the pockets are located at a predetermined position by rotation of the code gears and when the unlocking slide is actuated. A rotatable reset cam connected to the timing gear may also be provided such that the reset cam rotates the timing gear to a starting position after the timing gear is rotated by the idler gears.

The present invention provides new pushbutton door locks and door lock combination chambers to control access, such as to control access through doors. The new pushbutton door locks and door lock combination chambers provide convenient and cost effective ways of controlling access through doors. An advantage of the present invention is to provide new pushbutton door locks and door lock combination chambers which overcome deficiencies of existing access control devices.

Another advantage of the present invention is to provide reliable access control security.

Another advantage of the present invention is to provide narrow pushbutton locks for use with doors having a narrow door stile.

Another advantage of the present invention is to provide pushbutton locks having a door handle which unlatches the door latch and opens the door with a single operator movement.

Another advantage of the present invention is to provide pushbutton door locks having a linearly actuated door latch driver.

Another advantage of the present invention is to provide door lock combination chambers having a low profile.

Another advantage of the present invention is to provide door locks and door lock combination chambers which are simplified, have fewer components and are cost effective to manufacture.

Other advantages of the present invention will become apparent upon reading this disclosure including the appended claims and with reference to the accompanying drawings.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
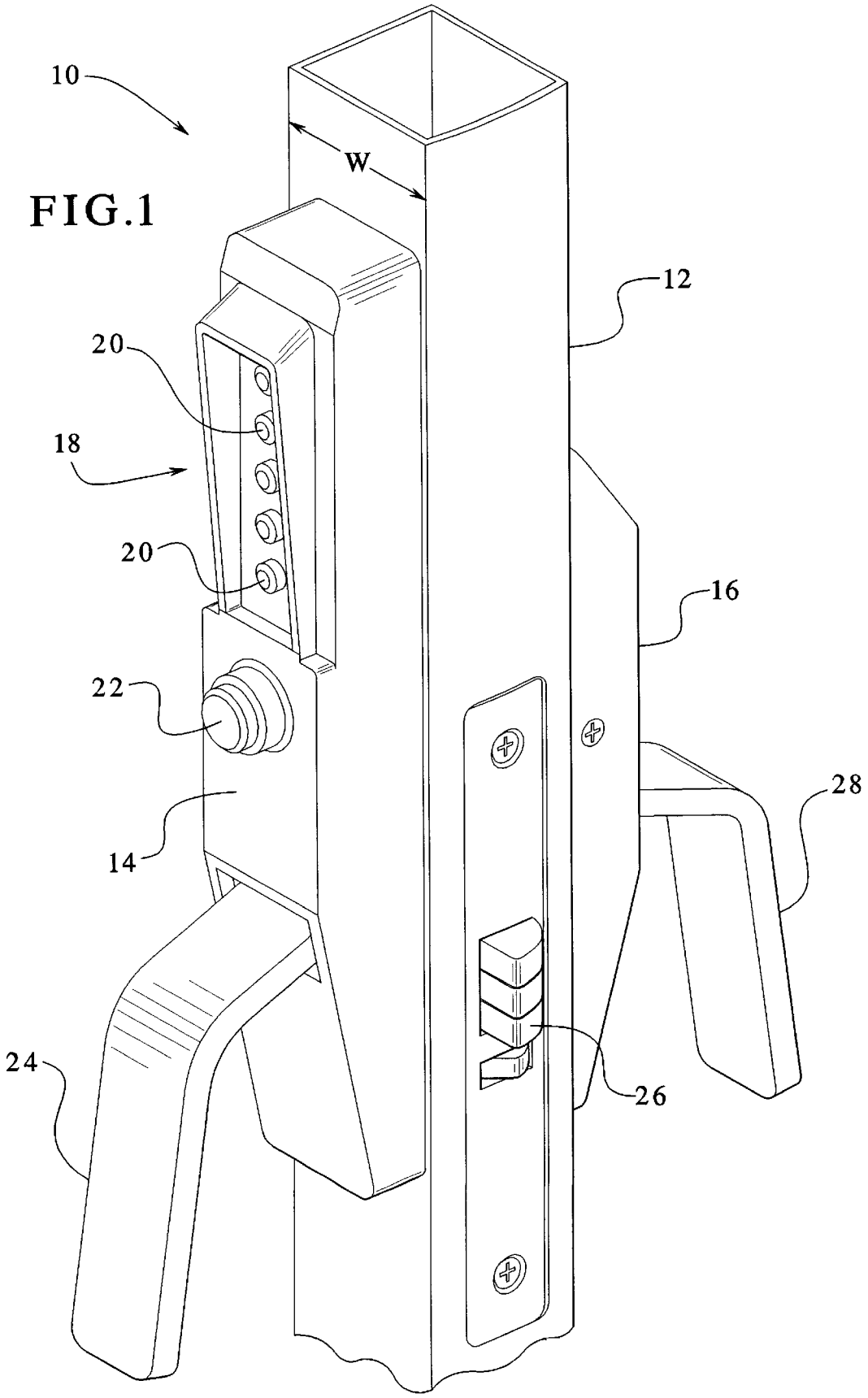
FIG. 1 is a perspective view of a pushbutton door lock and door lock combination chamber according to the principles of the present invention mounted on a door stile.

A new pushbutton door lock 10 according to the principles of the present invention as shown by way of example in FIG. 1. The pushbutton door lock 10 is mounted on a narrow door stile 12, such as a narrow aluminum stile for use with a glass door. The pushbutton door lock 10 has width small enough to permit the door lock 10 to be used with the narrow door stile 12 having a width W. The pushbutton door lock 10 also has a low profile such that the door lock 10 extends outward a relatively short distance away from the door stile 12.

The pushbutton door lock 10 has an outside unlatching mechanism contained within an outside housing 14 and mounted on an outside surface of the door stile 12 and an inside unlatching mechanism contained within an inside housing 16 and mounted on an inside surface of the door stile 12. The pushbutton door lock 10 provides controlled access on the outside of the door (a combination must be entered to unlock the lock) and uncontrolled access on the inside of the door (the door can be opened without entering a combination).

The pushbutton door lock 10 includes a combination chamber 18 having a plurality of pushbuttons 20 for entering the unlocking combination into the combination chamber 18. An operator actuatable go button 22 is provided to actuate the outside locking mechanism after the combination is entered into the combination chamber 18. An outside paddle 24 can be pulled to retract a door latch 26 and open the door after the unlocking combination is entered into the combination chamber 18 and the go button 22 is pressed. An inside paddle 28 can be pushed at any time to retract the door latch 26 and open the door whether or not the unlocking combination has been entered into the combination chamber 18. The door latch 26 is a mortise type latch mechanism and may have a deadlocking feature. The pushbutton door lock 10 may be designed for left-hand and right-hand doors with a reverse bevel, i.e. doors which are opened to the outside.

Figure 2:
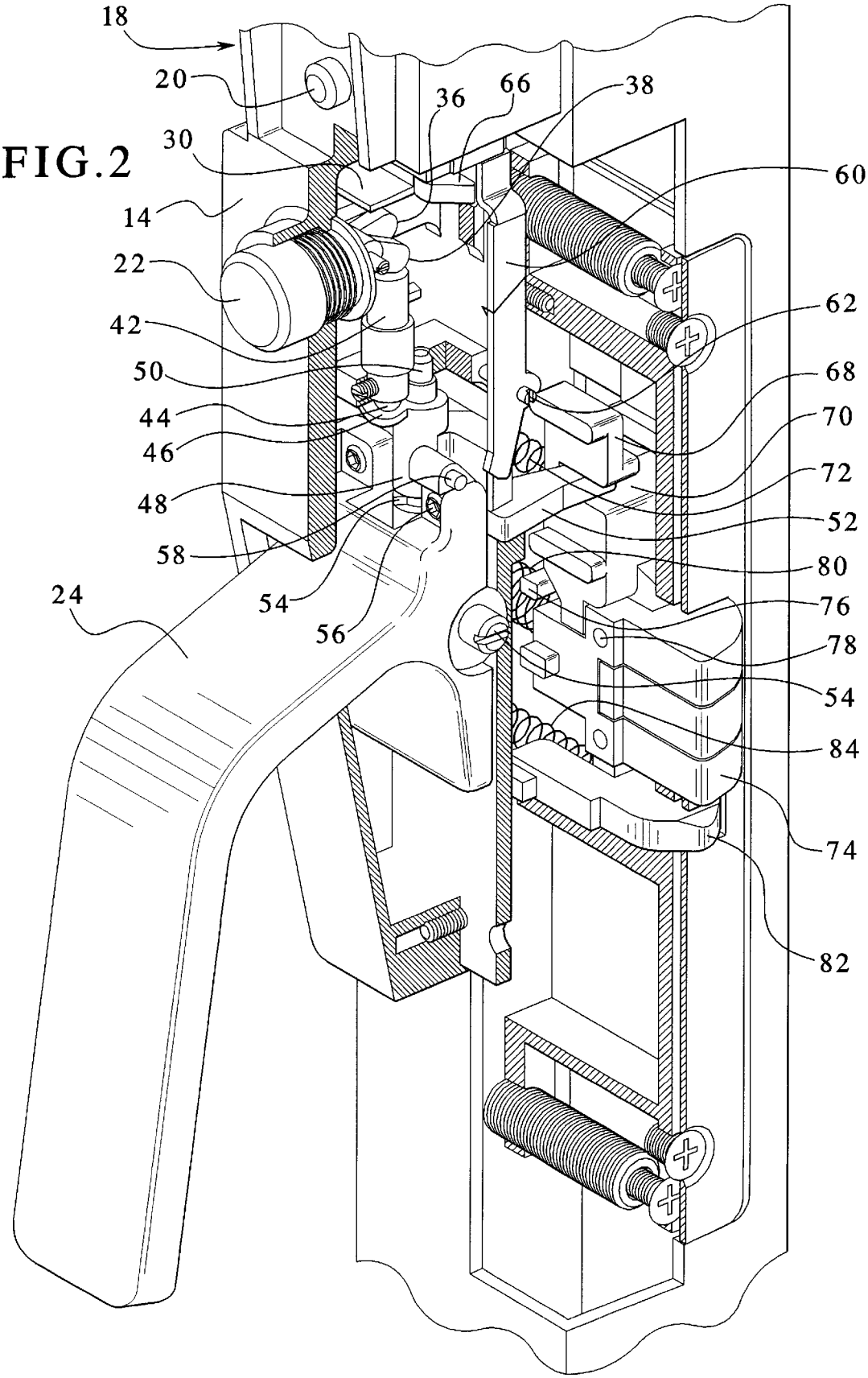
FIG. 2 is a partial cross-sectional, perspective view of the pushbutton door lock of FIG. 1.
Figure 3:
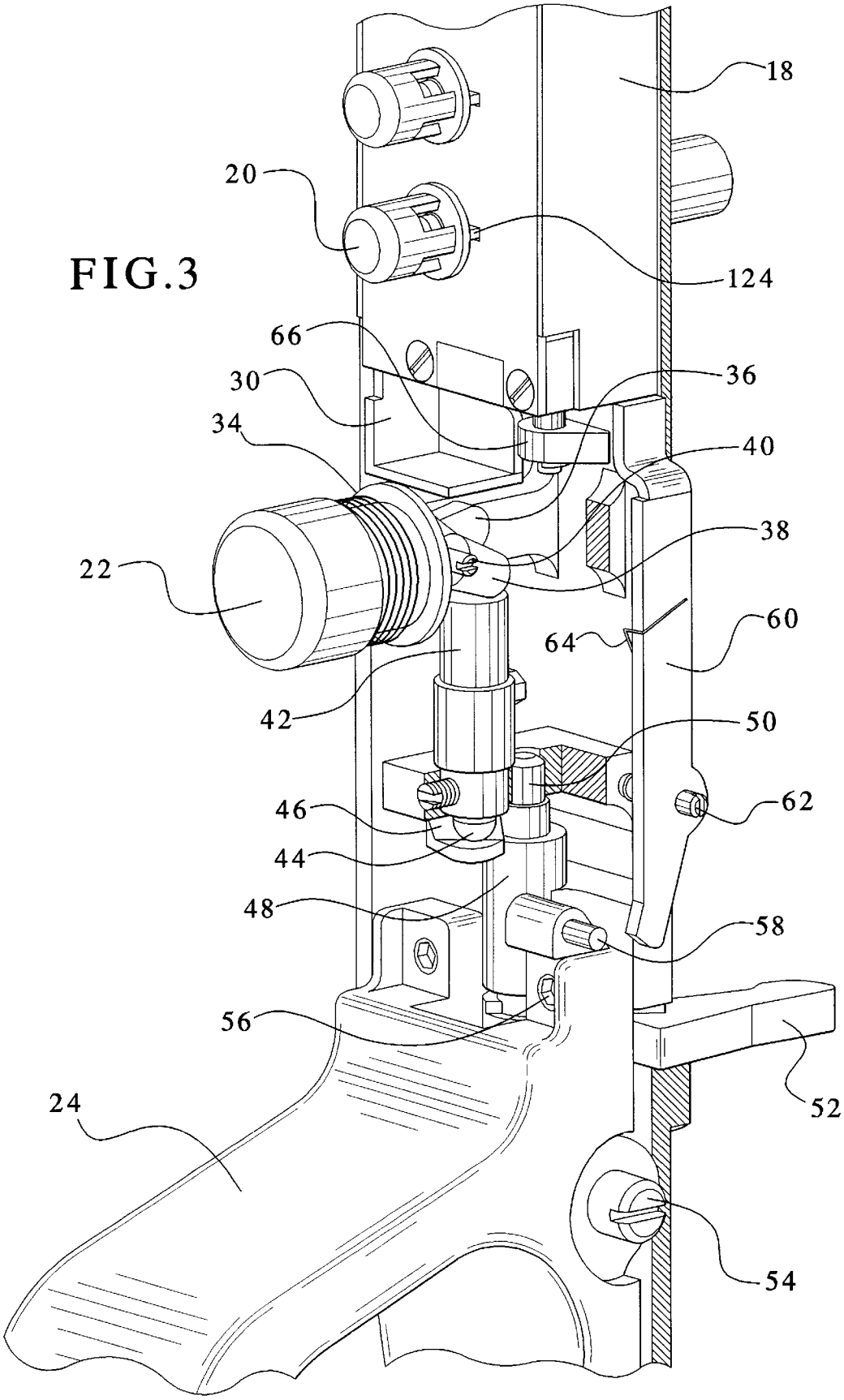
FIG. 3 is another partial cross-sectional, perspective view of the pushbutton door lock of FIG. 1.

Referring to FIGS. 2 and 3, the outside unlocking mechanism of the pushbutton door lock 10 is shown. The combination chamber 18 has an unlocking slide 30 which is slidable when the unlocking combination has been entered into the combination chamber 18 through the pushbuttons 20. The unlocking slide 30 cannot be moved unless the proper unlocking combination has been entered into the combination chamber 18.

The spring loaded go button 22 is biased outwardly by a spring 34. A chamber actuator 36 and a rotor actuator 38 are pivotally mounted on an actuator shaft 40. The chamber actuator 36 pivots upwardly to engage the unlocking slide 30 and slide the unlocking slide 30 upward after the unlocking combination has been entered into the combination chamber 18 and the go button 22 has been actuated. Similarly, the rotor actuator 38 pivots downwardly about actuator shaft 40 when the unlocking combination has been entered into the combination chamber 18 and the go button 22 has been actuated.

If the unlocking combination has not been entered into the combination chamber 18 the unlocking slide 30 will be prevented from sliding when the chamber actuator 36 engages the unlocking slide 30. Although the go button 22 can be depressed without entering the unlocking combination into the combination chamber 18, neither the chamber actuator 36 nor the rotor actuator 38 will pivot about the actuator shaft 40. The chamber and rotor actuators 36, 38 are prevented from pivoting about the actuator shaft 40 because the unlocking slide 30 maintains its position as shown in FIGS. 2 and 3.

The pushbutton door lock 10 includes a vertically orientated actuation button 42 engaged with the rotor actuator 38. The actuation button 42 has a lower rounded surface 44 which contacts a multi-level cam surface 46 on a rotor 48. The rotor 48 is pivotally mounted on an outside lever shaft 50 and can also move vertically along the outside lever shaft 50. Rotation of the rotor actuator 38 moves the actuation button 42 downward such that the rotor 48 moves downward by engagement of the lower rounded surface 44 and the multi-level cam surface 46.

An outside lever 52 is also rotatably mounted on the outside lever shaft 50. The outside lever 52 has a key 54 (FIG. 9) which engages a recess in the rotor 48 when the rotor 48 is moved vertically downward by the actuation button 42.

The outside paddle 24 is pivotally mounted on a base shaft 54 which is approximately parallel to the face of the door. Accordingly, the outside paddle 24 pivots perpendicularly relative to the outside face of the door. A set screw 56 is provided on the outside panel 24 to engage the rotatable rotor 48 when the outside paddle 24 is pulled and pivoted about the base shaft 54. The set screw 56 is adjustable to vary the amount of pull required on the outside paddle 24 to engage the set screw 56 with the rotor 48. A groove pin 58 is also provided on the outside panel 24. The groove pin 58 is engageable with a reset blink 60 which is pivotal about a reset link pin 62. A spring 64 biases the reset link 60 toward an initial position as shown in FIGS. 2 and 3. The rotatable reset link 60 engages a reset cam 66 on the combination chamber 18 as described further below.

Figure 5:
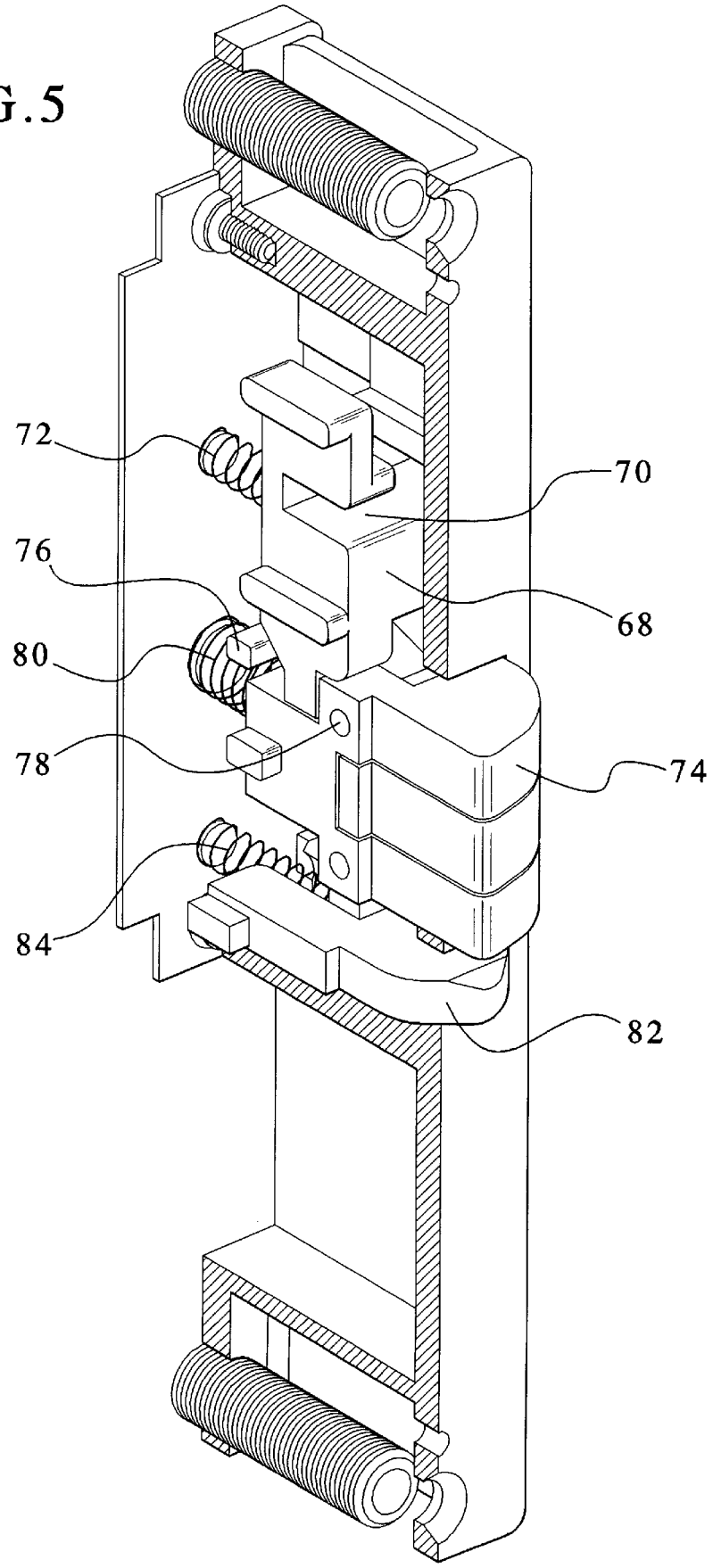
FIG. 5 is a perspective view of a latch mechanism of the pushbutton door lock of FIG. 1.

Referring to FIGS. 2 and 5, the outside lever 52 is engaged with a latch driver 68 by being inserted into an outside lever engagement recess 70. The latch driver 68 is linearly slidable and is biased to a forward position by a driver spring 72. The linearly slidable latch driver 68 is engageable with a latch bolt 74. Specifically, the latch driver 68 is engageable with an arm 76 which is pivotally attached to the latch bolt 74 by a pivot 78. The latch bolt 74 is biased outward toward an extended position by a latch bolt spring 80. An auxiliary bolt 82 and an auxiliary bolt spring 84 may also be provided as is known in the art.

Figure 4:
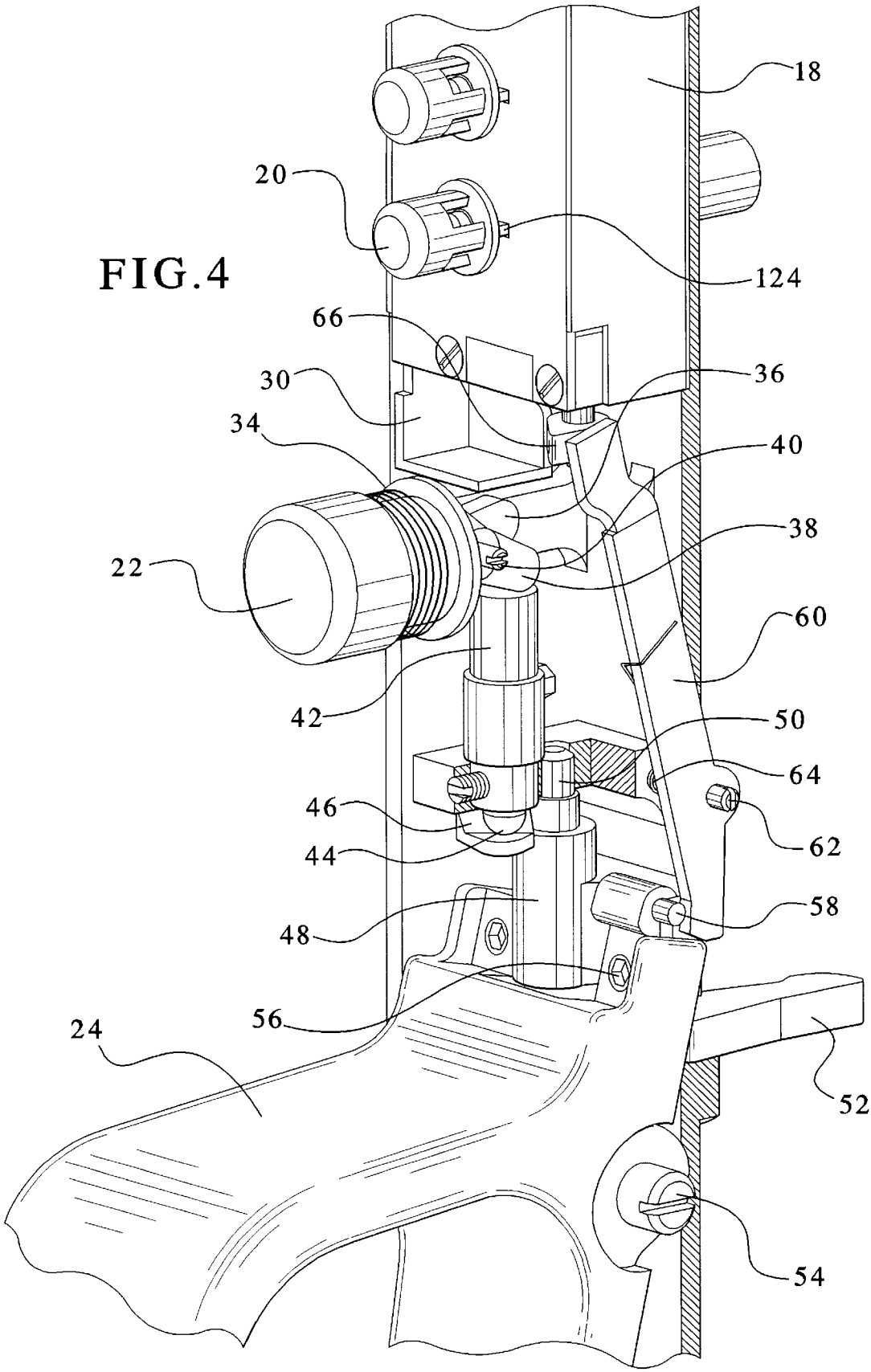
FIG. 4 is a perspective view of the pushbutton door lock of FIG. 1 showing an outside paddle in an actuated position.

Referring to FIG. 4, the pushbutton door lock 10 is shown in the position after the outside paddle 24 has been pulled. The set screw 56 on the outside paddle 24 engages the rotor 48 and rotates the rotor 48 about the outside lever shaft 50. If the rotor 48 is engaged with the outside lever 52, the outside lever 52 slides the latch driver 68 (FIG. 5) to a rearward position which retracts the latch bolt 74. Regardless of whether the rotor 48 is engaged with the outside lever 52, the multi-level cam surface 46 of the rotor 48 pushes the actuation button 42 upward by engagement with the lower rounded surface 44. This returns the actuation button 42 to its initial, unactuated position.

The groove pin 58 engages one end of the reset link 60 and rotates the reset link 60 about the reset link pin 62. An opposite end of the reset link 60 engages and rotates the reset cam 66 of the combination chamber 18 to reset the combination chamber 18. Continued pulling of the outside paddle by an operator 24 will open the door. When the outside paddle 24 is released the outside paddle 24 pivots to its unactuated position as does the rotor 48, the reset link 60 and the reset cam 66. The outside lever 52 also returns to its unactuated position if it had been rotated by engagement with the rotor 48.

Figure 6:
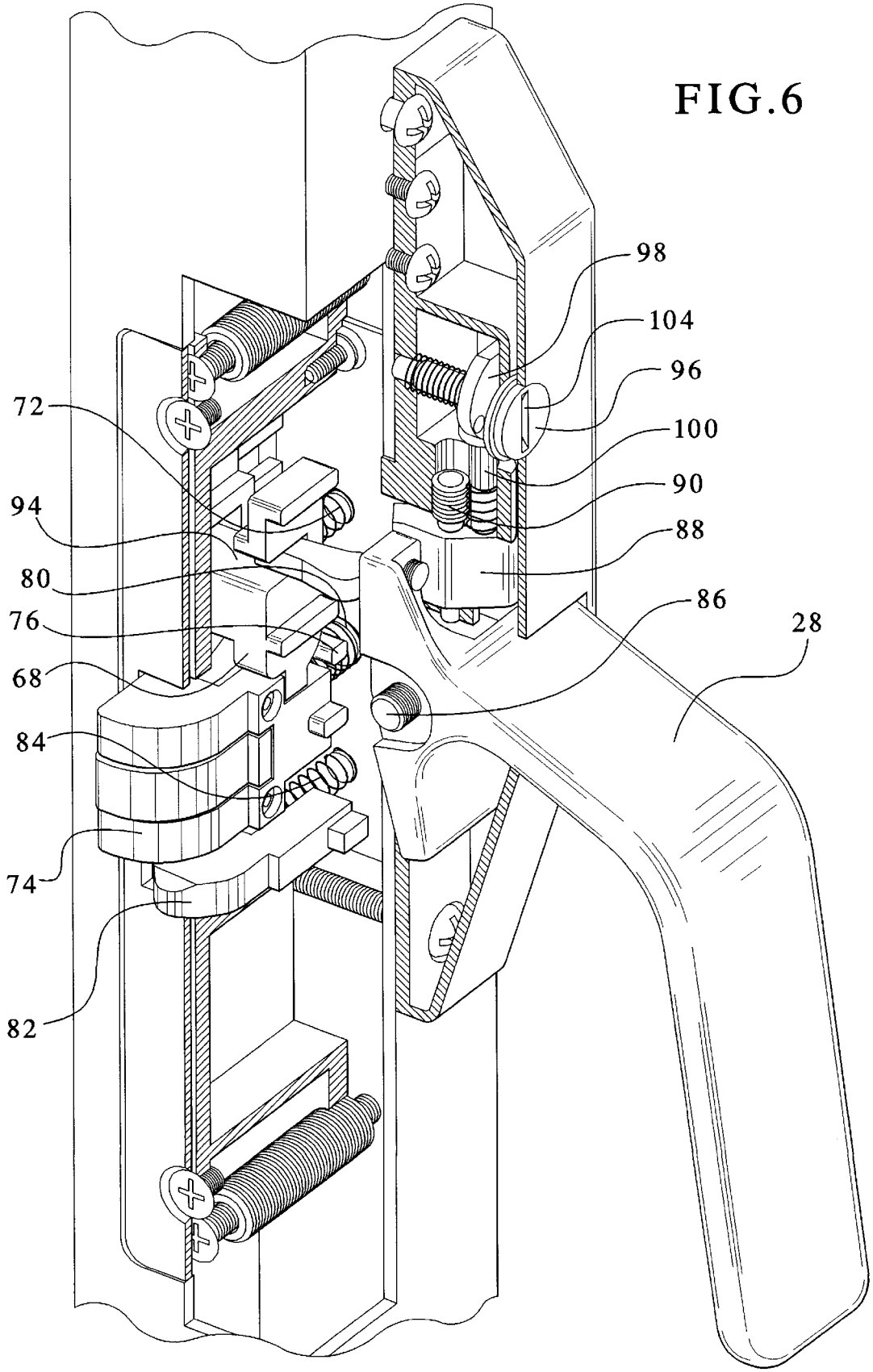
FIG. 6 is a partial cross-sectional, perspective view of the pushbutton door lock of FIG. 1 showing the door lock from the inside, unlocked side of the door.
Figure 9:
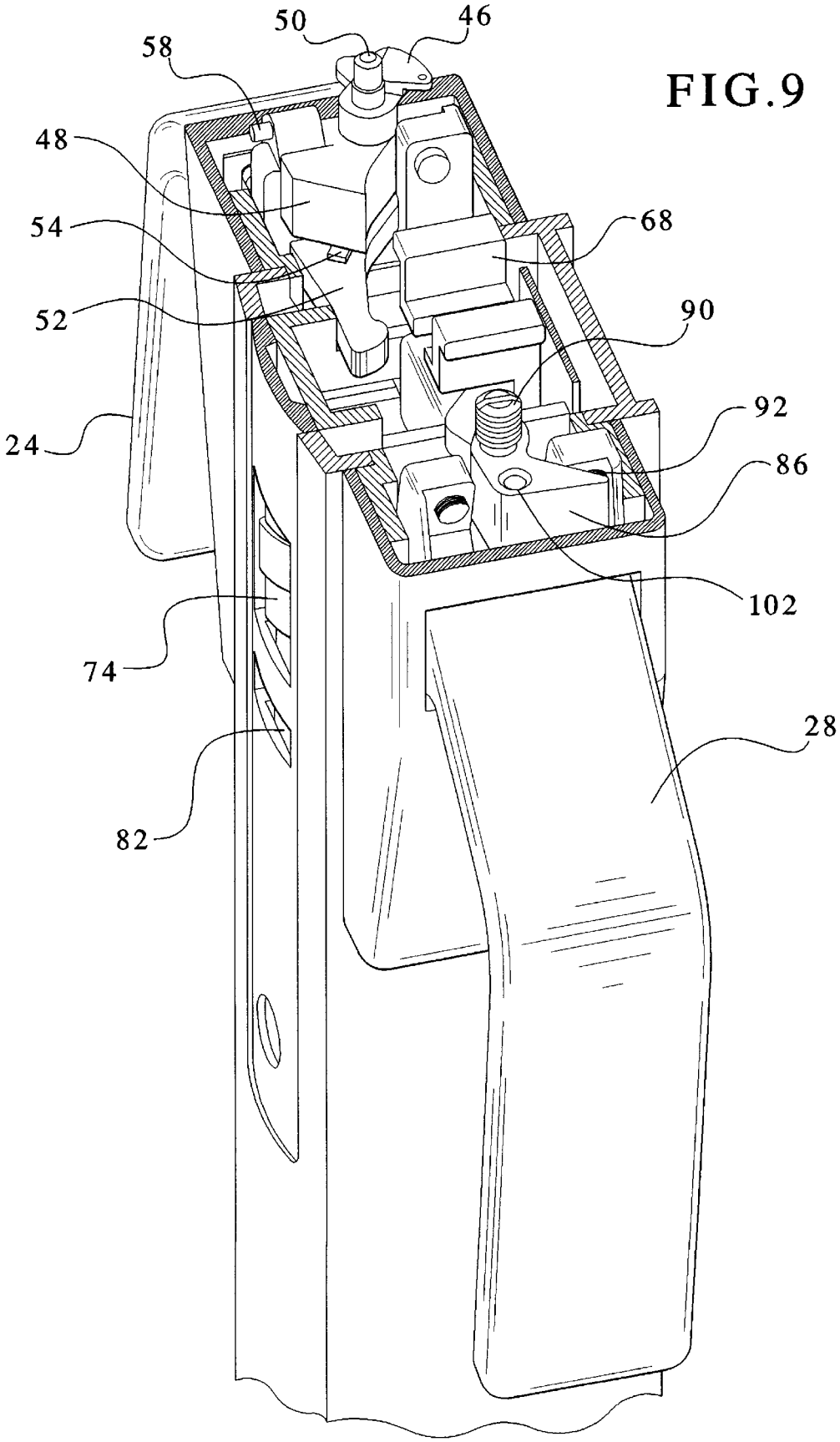
FIG. 9 is another cross-sectional view of the pushbutton door lock of FIG. 1.

Referring to FIG. 6, the inside unlocking mechanism of the pushbutton door lock 10 is shown. The inside paddle 28 is pivotable about a base shaft 86 perpendicularly relative to an inside face of the door. An inside lever 88 is rotatable about an inside lever shaft 90 when engaged by the inside paddle 28. An adjustable set screw 92, which is similar to the adjustable set screw 56 on the outside paddle 24, is provided on the inside paddle 28 to engage the inside lever 88 as shown in FIG. 9.

Referring to FIG. 6, the inside lever 88 is engaged with the latch driver 68. Specifically, the inside lever 88 is engaged with an inside lever engagement recess 94 of the latch driver 68.

Figure 7:
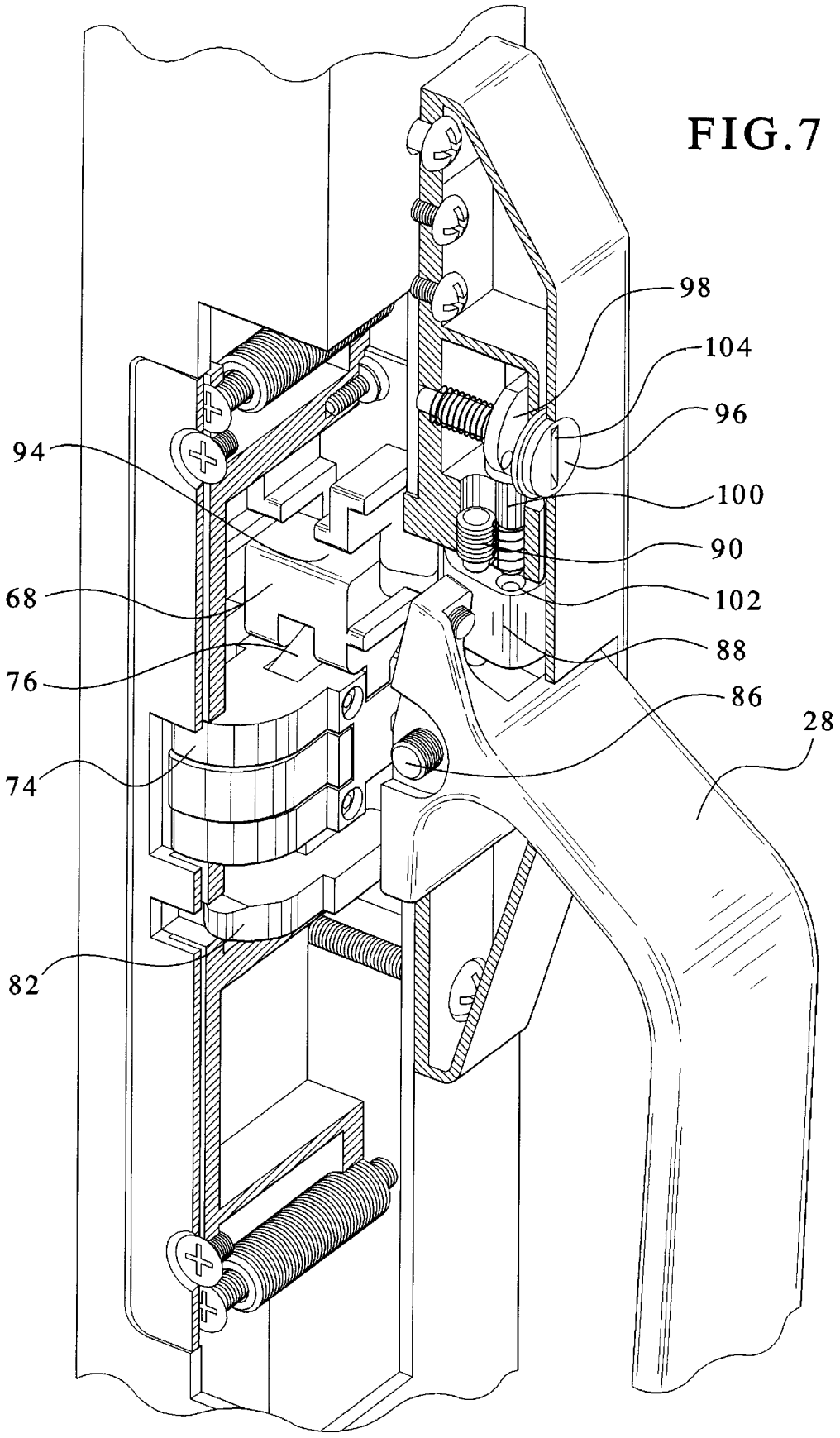
FIG. 7 is a perspective view of the pushbutton door lock of FIG. 6 showing the door latch retracted.

Referring to FIG. 7, the inside portion of the pushbutton door lock 10 is shown in an actuated position. The inside paddle 28 is pivoted about the base shaft 86 by pushing forward on the inside paddle 28. The set screw 92 on the inside paddle 28 engages the inside lever 88 and rotates the inside lever 88 in a clockwise direction about the inside lever shaft 90 (FIG. 9). The inside lever 88 is engaged with the latch driver 68 which linearly slides the latch driver 68 to a rearward position retracting the latch bolt 74. In this manner, the pushbutton door lock 10 provides uncontrolled access through the door by actuation of the inside paddle 28. Continued pushing of the inside paddle by an operator will open the door.

Figure 8:
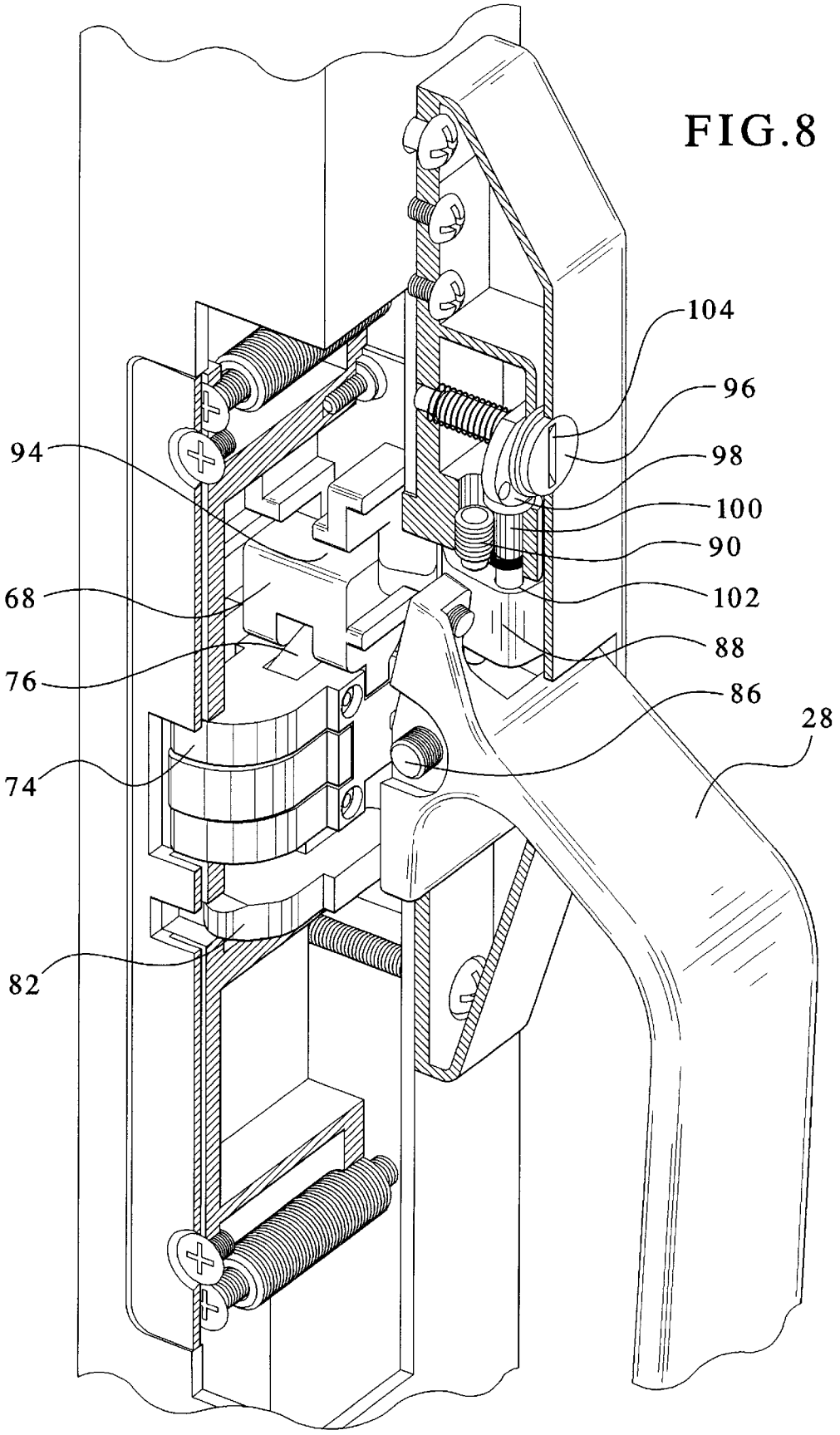
FIG. 8 is a perspective view of the pushbutton door lock of FIG. 7 showing the door lock held in an open position.

Referring to FIGS. 7 and 8, a hold open mechanism may be included in the pushbutton door lock 10. The hold open mechanism includes a rotatable turn knob 96 connected to a rotatable holding cam 98. A spring loaded vertically movable holding pin 100 can be pushed down into a pin receiving hole 102 in the inside lever 88 by rotation of the turn knob 96 and the holding cam 98 when the inside lever 88 is rotated to align the pin receiving hole 102 with the holding pin 100. In this position, the pushbutton door lock 10 remains unlocked and the door remains open. The turn knob 96 and the holding cam 98 can be rotated back to their original positions to remove the holding pin 100 from the pin receiving hole 102, and thus allow the pushbutton door lock 10 to be locked. A slot 104 is provided in the turn knob 96 for insertion of a coin to assist in turning the turn knob 96.

Figure 10:
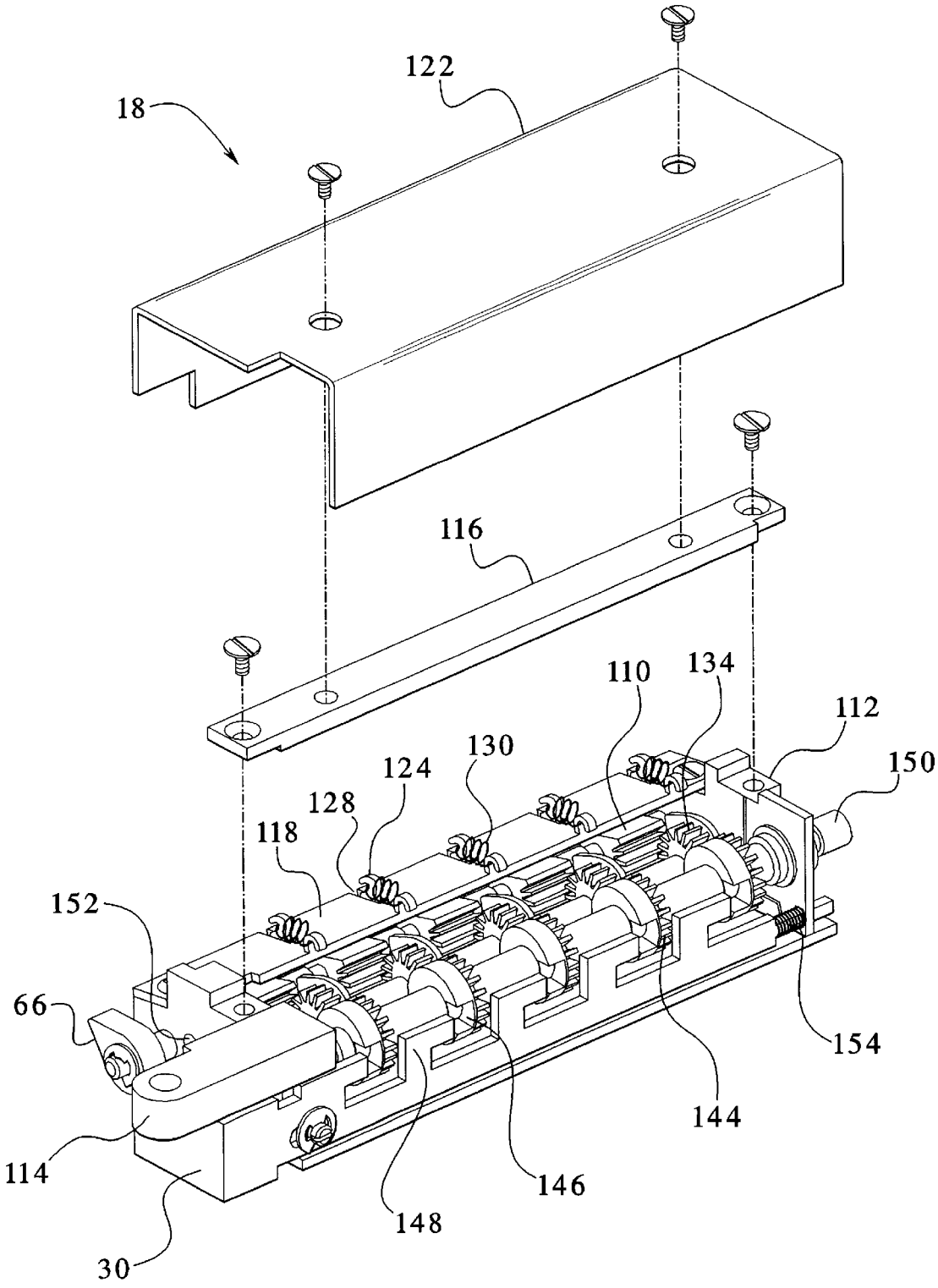
FIG. 10 is a perspective view of a door lock combination chamber of the pushbutton door lock of FIG. 1 according to the principles of the present invention.
Figure 11:
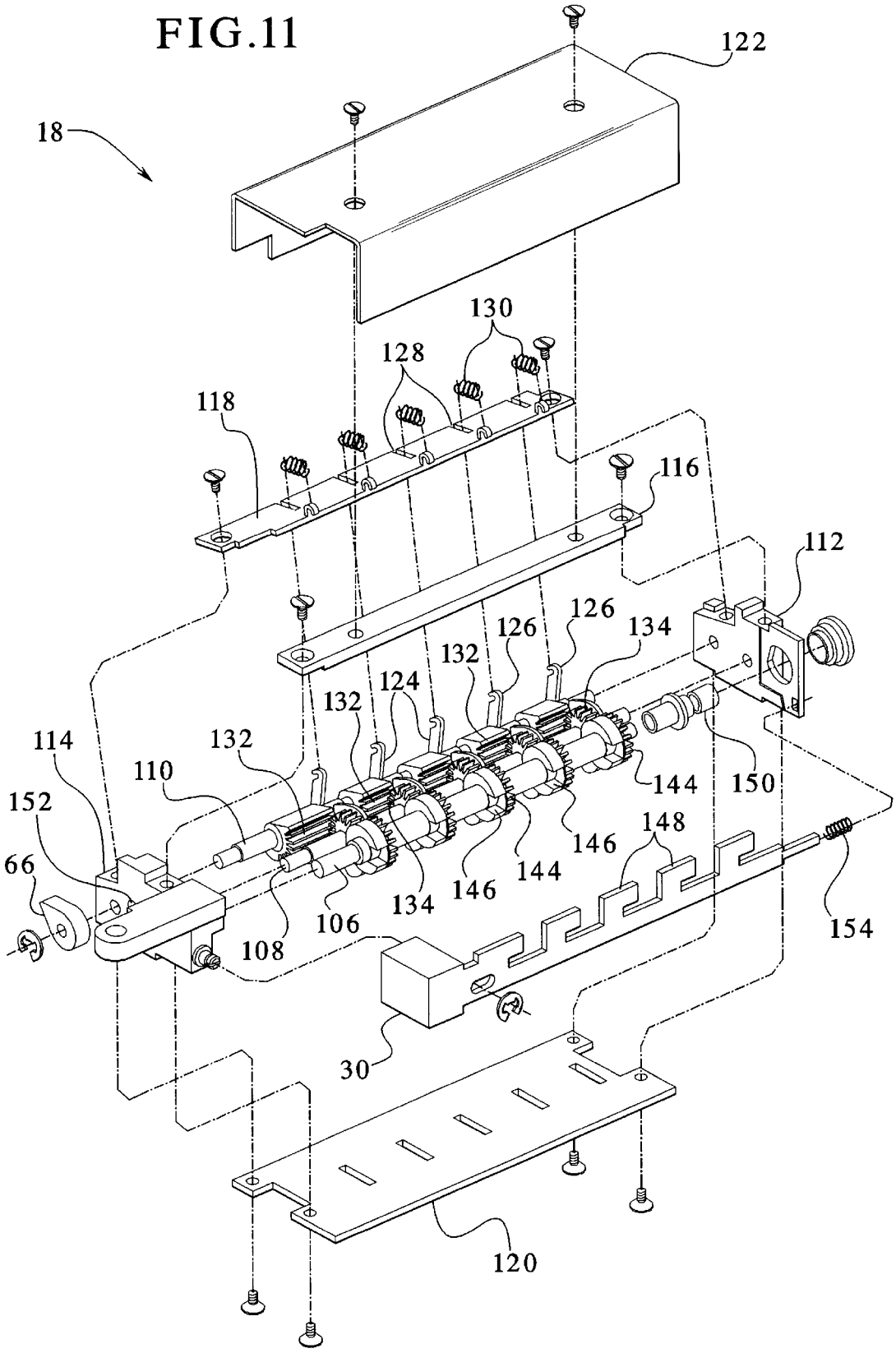
FIG. 11 is an exploded, perspective view of the door lock combination chamber of FIG. 10.
Figure 12:
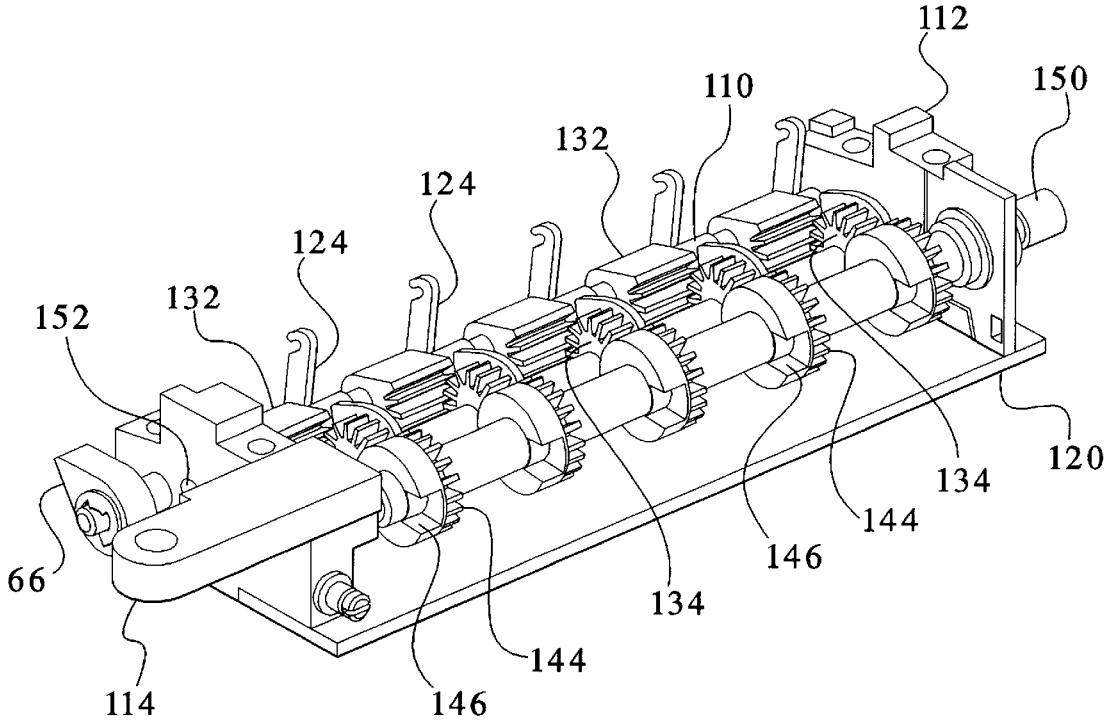
FIG. 12 is another perspective view of the door lock combination chamber of FIG. 10, with a portion of the combination chamber removed.

Referring to FIGS. 10–12, the combination chamber 18 will be further described. The combination chamber 18 includes a rotatable code gear shaft 106, a rotatable idler gear shaft 108, and a rotatable timing gear 110. The code gear shaft 106, the idler gear shaft 108, and the timing gear 110 are rotatably mounted on top and bottom end plates 112, 114 which are held together by a tie bar 116, a rotary key guide 118 and a front plate 120. A cover 122 may also be provided to enclose the combination chamber 18.

Five rotary keys 124 are rotatably mounted on the timing gear 110, and each rotary key 124 has a hooked end 126 extending through a key slot 128 in the rotary key guide 118. Five homing springs 130 are connected to the hooked ends 126 of the rotary keys 124 and to the rotary key guide 118 to bias the rotary keys 124 in a home position, as shown in FIG. 10. Each one of the rotary keys 124 is associated with one of the pushbuttons 20 of the combination chamber 18. When a particular pushbutton 20 is pressed the corresponding rotary key 124 moves against the biasing force of the homing spring 130 and rotates about the timing gear 110. Five gear sections 132 are provided on the time gear 110 in which each gear section 132 is associated with one rotary key 124. Each of the gear sections 132 are fixedly attached to the timing gear 110, while the rotary keys 124 are freely rotatable on the timing gear 110. Each rotary key 124 engages an idler gear 134 when a pushbutton is depressed as more fully described below.

Figure 13:
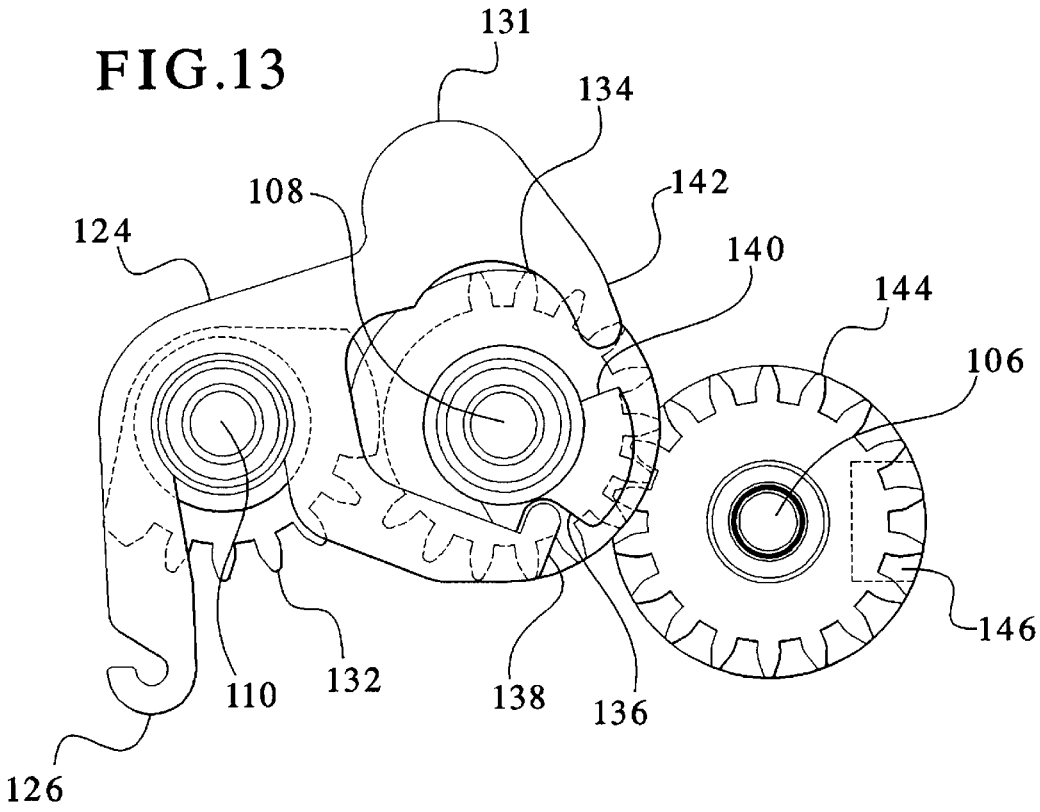
FIG. 13 is an end view of a gear mechanism of the door lock combination chamber of FIG. 10 showing the combination chamber prior to actuation of the pushbuttons.

Five idler gears 134 are secured to the idler gear shaft 108 and engaged with corresponding gear sections 132 on the timing gear 110. Referring to FIG. 13, each one of the idler gears 134 has an index pocket 136 for receiving a fixing leg 138 of the rotary key 124. Each idler gear 134 also has a flat area 140 for engagement with a pushing leg 142 on the rotary key 124.

Referring back to FIGS. 10–12, the code gear shaft 106 has five spaced apart code gears 144. Each code gear 144 is engaged with a corresponding idler gear 134. A pocket 146 is defined in each one the code gears 144 for receiving a leg 148 of the unlocking slide 30. The code gears 144 are freely rotatable on the code gear shaft 106 except for their engagement with the idler gears 134. A code gear shaft button 150 is provided to be actuated and axially slide the code gear shaft 106 such that the code gears 144 disengage the respective idler gears 134. The code gears 144 are disengaged from the idler gears 134 to set the unlocking combination as described below.

The unlocking slide 30 can be pushed (i.e. by actuation of the go button 22) to axially slide the code gear shaft 106 to reengage the code gears 144 and the idler gears 144. The reset cam 66 is connected to the timing gear 110 such that the rotation of the reset cam 66 by the reset link 60 rotates the timing gear 110. A spring loaded ball plunger 152 is provided in the bottom end plate 114 to engage the teeth in the closest gear section 132 of the timing gear 110. The spring loaded ball plunger 152 maintains the timing gear 110 in desired positions by allowing the timing gear 110 to rotationally index as the ball plunger 152 engages the gear section 132 between the gear section teeth.

Rotation of the reset cam 66 by the reset link 60 rotates the timing gear 110 and resets the combination chamber 18 to the initially programmed unlocking code combination after each attempt to operate the pushbutton door lock 10, i.e. by pulling on the outside paddle 24.

Operation of the pushbutton door lock 10 will now be further described. The new unlocking combination code can be set for the combination chamber 18 when the pockets 146 of the code gears 144 are aligned with their respective legs 148 of the unlocking slide 30. The code gear shaft button 150 is pushed downward which axially slides the code gear shaft 106 downward such that each pocket 146 of the code gears 144 receives one of the legs 148 of the unlocking slide 30. In this position, the code gears 144 are disengaged from their respective idler gears 134. Access to the code gear shaft button 150 can be provided by partially disassembling the pushbutton door lock 10 or by providing some other controlled access to the code gear shaft button 150.

Figure 14:
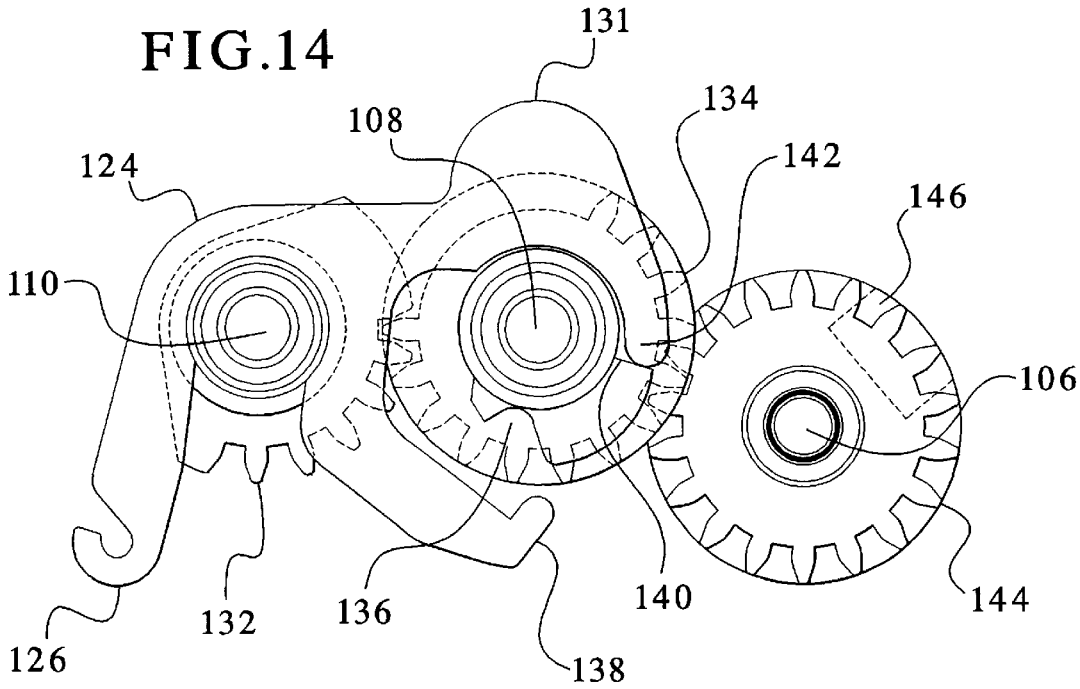
FIG. 14 is an end view of the gear mechanism of FIG. 13 after a pushbutton has been actuated.

Referring to FIG. 1, the pushbuttons 20 of the combination chamber 18 are pressed in a desired sequence to define the unlocking combination. Referring to FIGS. 13 and 14, pushing a particular pushbutton 20 contacts the radial part 131 on a corresponding rotary key 124 and rotates the rotary key 124 about the timing gear 110. As the rotary key 124 rotates, the fixing leg 138 of the rotary key 124 moves out of the index pocket 136 on the idler gear 134. Also, the pushing leg 132 of the rotary key 124 engages the flat area 140 on the idler gear 134 and rotates the idler gear 134 and the idler gear shaft 108. Because the idler gears 134 are engaged with the corresponding gear sections 132 of the timing gear 110, the timing gear also rotates, although in the opposite direction from rotation of the idler gear shaft 108. For example, the idler gear shaft 108 may rotate 40° and the timing gear 110 may rotate 20° in the opposite direction of rotation of the idler gear shaft 108. The ball plunger 152 maintains rotation of the timing gear 110 in desire locations by indexing each rotation of the timing gear 110. The ball plunger 152 indexes rotation of the timing gear 110 by engaging the closes gear section 132 between the teeth of the gear section. Each idler gear 134 can be rotated by its respective rotary key 124 only once in any sequence of pressing the pushbuttons 20 individually or simultaneously with more than one pushbutton 20 depressed at the same time.

After the unlocking combination is set, the code gears 144 are engaged with the idler gears 134 by pushing the unlocking slide 30 upward. The unlocking slide 30 can be pushed upward by pressing the go button 22. An unlocking slide spring 154 is provided to return the unlocking slide 30 to its downward position which is disengaged from the code gears 144.

Referring to FIG. 4, the outside paddle 24 is pulled which causes the groove pin 58 to engage the reset link 60 and rotate the reset link 60 against the return spring 64 to engage the reset cam 66. Referring to FIGS. 10–12, rotation of the reset cam 66 in a counter-clockwise direction rotates the timing gear 110 and the idler gears 134 to their original positions. Because the idler gears 134 are engaged with their respective code gears 144, the code gears 144 are rotated together with the idler gears 134. Rotation of the code gears 144 misaligns the pockets 146 in the code gears 144 from the legs 148 of the unlocking slide 30. Accordingly, when the go button 22 (FIG. 3) is pressed and the chamber actuator 36 engages the unlocking slide 30, the unlocking slide 30 will not slide upward. The unlocking slide 30 is prevented from sliding upward because the ends of the legs 148 on the unlocking slide 30 contact the areas of the code gears 144 which do not have the pockets 146, i.e. the pockets 146 are not aligned with the legs 148.

If an incorrect unlocking code is entered into the combination chamber 18 or no code is entered, the pushbutton door lock 10 will not open. If any of the pushbuttons 20 have been pressed the gear mechanism in the combination chamber 18 will be rotated accordingly. In particular the idler gears 134, the timing gear 110 and the code gears 144 will all rotate. However, the pockets 146 and the code gears 144 will not be aligned with the legs 148 on the unlocking slide 30.

An operator desiring to open the door will press the go button 22 which attempts to pivot the chamber actuator 36 and the rotor actuator 38, with reference to FIG. 6. The chamber actuator 36 engages the unlocking slide 30 but will not slide the unlocking slide 30 upward. Because the pivotal movement of the chamber actuator 36 is limited by the immobile unlocking slide 30, the rotor actuator 38 will be unable to push the actuation button 42 downward. Accordingly, the rotor 48 will not be moved into engagement with the outside lever 52.

Referring to FIG. 7, the operator will pull on the outside paddle 24 which will rotate the rotor 48 without rotating the outside lever 52. Referring to FIG. 2, the latch driver 68 will not be slide by the outside lever 52 and the latch bolt 74 will be maintained in its extended position.

Referring to FIG. 7, rotation of the outside paddle 24 causes rotation of the reset link 60 due to engagement of the groove pin 58 with the reset link 60. The reset link 60 rotates the reset cam 66 which resets the combination chamber 18 as described above. The pushbutton door lock 10 is now in position for another attempt at unlocking the door lock and opening the door.

Referring to FIGS. 2 and 10, if the correct unlocking code is entered into the combination chamber 18 the idler gears 134 and the code gears 144 will be rotated in the proper sequence. The pockets 146 and the codes gears 144 will be properly aligned with the legs 148 of the unlocking slide 30.

Referring to FIGS. 2 and 4, the go button 22 is pressed and the chamber actuator 36 pushes the unlocking slide 30 upward to engage the legs 148 in the pockets 146. As the unlocking slide 30 moves upward, the rotor actuator 38 pushes the actuation button 42 downward which pushes the rotor 48 into engagement with the outside lever 52. As the outside paddle 24 is pulled the set screw 56 engages the rotor 48 to rotate the rotor 48 and the outside lever 52. The outside lever 52 linearly slides the latch driver 68 which retracts the latch bolt 74. Concurrently, the reset link 60 and the reset cam 66 reset the combination chamber 18 as described above. Also, as the operator pulls on the outside paddle 24 all in a single motion the door will open after the latch bolt 74 is retracted.

The latch driver 68 slides linearly over the arm 76 of the latch bolt 74 and rotates the arm 76 downward about the pivot 78. Rotation of the latch bolt arm 76 pushes the arm out of corresponding pockets in a housing of the door lock 10. Further sliding of the latch driver 68 pulls the arm 76 together with the latch bolt 74 to a position where the latch bolt 74 is fully retracted along with the auxiliary bolt 82. The door is now unlocked. Normally, when the auxiliary bolt 82 is depressed by the door's edge when the door is closed, the auxiliary bolt 82 allows the arm 76 of the latch bolt 74 to deadlock the latch bolt 74 as is known.

As the outside paddle 24 rotates the rotor 48 by engagement of the set screw 56 with the rotor 48, the multi-level cam surface 46 pushes the lower rounded surface 44 of the actuation button 42 upward. This automatically returns the actuation button 42 to its original position.

The operator releases the outside paddle 24 and the outside paddle 24 pivots back to its original at rest position. Referring to FIG. 5, the driver spring 72 returns the latch driver 68 to its at rest position and the latch bolt spring 80 returns the latch bolt 74 to its extended position. Referring to FIG. 2, the outside lever 52 and the rotor 48 rotate back to their at rest positions. The rotor 48 is spring loaded such that the rotor 48 is biased to a position disengaged from the outside lever 52. Accordingly, the rotor 48 returns to its at rest position disengaged from the outside lever 52.

The inside part of the pushbutton door lock 10 operates as follows. Referring to FIGS. 6–9, the inside paddle 28 is pushed toward the door and pivoted around the base shaft 86. The set screw 92 (FIG. 9) applies pressure to the inside lever 88 in a direction opposite to the door's inside surface. The inside lever 88 is rotated about the inside lever shaft 90 and the inside lever 88 engages the latch driver 68. The inside lever 88 slides the latch driver 68 and unlatches the latch bolt 74 and the auxiliary bolt 82 similarly as described with reference to the outside lever 52.

After the operator releases the inside paddle 28, the inside lever 88, the latch driver 68, the latch bolt 74 and the auxiliary bolt 82 return to their at rest positions.

Referring to FIGS. 6–8, the door lock 10 can be held in an unlocked position as follows. When the inside paddle 28 is fully depressed and the inside lever 88 is fully rotated, a coin can be inserted into the slot 104 of the turn knob 96. The turn knob 96 can be rotated 180° in either direction. Because the turn knob 96 is engaged with the holding cam 98, the holding cam 98 rotates and applies pressure to the spring loaded holding pin 100. The holding pin 100 sits into the pin receiving hole 102 of the inside lever 88 underneath the holding cam 98. The holding pin 100 maintains the inside lever 88 in the unlocked position which maintains the latch driver 68 and the latch bolts 74, 82 in the retracted positions. Accordingly, the pushbutton door lock remains in an unlocked position.

The turn knob 96 can be rotated 180° in either direction to rotate the holding cam 98 remove the holding pin 100 from the pin receiving hole 102 in the inside lever 88. This releases the inside lever 88 and allows the lock components to return to the locked position including the latch bolts extending outward from the door.

While the presently preferred embodiments have been illustrated and described, numerous changes and modifications can be made without significantly departing from the spirit and scope of this invention. Therefore, the inventor intends that such changes and modifications are covered by the appended claims.

The invention is claimed as:

1. A lock combination chamber comprising:

a rotatable timing gear having a plurality of gear sections;

a plurality of rotary keys mounted on the timing gear and rotatable relative to the timing gear, each one of the rotary keys associated with one of the gear sections of the timing gear;

an idler gear shaft having a plurality of rotatable idler gears, each one of the idler gears engaged with one of the rotary keys and with one of the gear sections of the timing gear after rotation of the idler gear by contact with one of the rotary keys rotating on the timing gear;

a code gear shaft having a plurality of rotatable code gears, each one of the code gears engaged with one of the idler gears and defining a pocket; and an unlocking slide having a plurality of legs inserted into the pockets of the code gears when the pockets are located at a predetermined position by rotation of the code gears and the unlocking slide is actuated.

2. The lock combination chamber of claim 1 further comprising a plurality of biasing members in which each one of the biasing members is attached to one of the rotary keys and a rotary key guide such that the rotary key is biased towards a particular rotary key position.

3. The lock combination chamber of claim 2 wherein each one the rotary keys has a hooked end extending through a slot in the rotary key guide, and wherein each one of the biasing members is a spring attached to the hooked end of one of the rotary keys and attached to the rotary key guide.

4. The lock combination chamber of claim 1 wherein each one of the rotary keys has a fixing leg and each one of the idler gears has an index pocket, each one of the fixing legs received in one of the index pockets prior to engagement of the idler gear with the timing gear, and wherein each one of the rotary keys has a pushing leg which is in contact with one of the idler gears when the rotary key is rotated.

5. The lock combination chamber of claim 4 wherein each one of the rotary keys has an actuation portion extending away from the timing gear and capable of actuation to rotate the rotary key about the timing gear.

6. The lock combination chamber of claim 1 wherein the code gears are slidably mounted relative to the idler gears along axial directions of the code gear shaft into and out of engagement with their respective idler gears when the pockets of the code gears are located at the predetermined position.

7. The lock combination chamber of claim 6 further comprising a code gear shaft button in contact with the code gear shaft, the code gear shaft button sliding the code gear shaft and the code gears along one axial direction to slide the code gears out of engagement with their respective idler gears when the pockets of the code gears are located at the predetermined position.

8. The lock combination chamber of claim 1 wherein the unlocking slide is biased toward a locked position in which the legs are spaced away from the pockets of the code gears and slidable to an unlocked position in which the legs are received in their respective pockets when the pockets are located at the predetermined position.

9. The lock combination chamber of claim 1 further comprising a rotation indexer engaged with the timing gear at predetermined angular locations which defines incremental rotations of the timing gear.

10. The lock combination chamber of claim 9 wherein the rotation indexer engages the timing gear between adjacent gear teeth on the timing gear.

11. The lock combination chamber of claim 1 further comprising a rotatable reset cam connected to the timing gear, the reset cam rotating the timing gear to a starting position after the timing gear is rotated by the idler gears.

12. The lock combination chamber of claim 1 further comprising:

a top end plate and a bottom end plate supporting the timing gear, the idler gear shaft and the code gear shaft;

a tie bar connected to the top and bottom end plates; and a rotary key guide connected to the top and bottom end plates, the rotary key guide having a plurality of key slots in which each one of the rotary keys extends through one of the key slots.

13. A pushbutton lock combination chamber comprising:

a rotatable timing gear having a plurality of gear sections;

a plurality of rotary keys mounted on the timing gear and rotatable relative to the timing gear, each one of the rotary keys associated with one of the gear sections of the timing gear;

an idler gear shaft having a plurality of rotatable idler gears, each one of the idler gears engaged with one of the rotary keys and with one of the gear sections of the timing gear after rotation of the idler gear by contact with one of the rotary keys rotating on the timing gear;

a code gear shaft having a plurality of rotatable code gears, each one of the code gears in engaged with one of the idler gears and defining a pocket;

a rotatable reset cam connected to the timing gear, the reset cam rotating the timing gear to a starting position after the timing gear is rotated by the idler gears;

a top end plate and a bottom end plate supporting the timing gear, the idler gear shaft and the code gear shaft;

a rotary key guide connected to the top and bottom end plates, the rotary key guide having a plurality of key slots in which each one of the rotary keys extends through one of the key slots;

a plurality of biasing members in which each one of the biasing members is attached to one of the rotary keys such that the rotary key is biased towards a particular rotary key position; and an unlocking slide having a plurality of legs inserted into the pockets of the code gears when the pockets are located at a predetermined position by rotation of the code gears and the unlocking slide is actuated.

14. The pushbutton lock combination chamber of claim 13 wherein the code gear shaft is slidably mounted on the top and bottom end plates along axial directions of the code gear shaft such that the code gears are slid into and out of engagement with their respective idler gears when the pockets of the code gears are located at the predetermined position.

15. The pushbutton lock combination chamber of claim 14 wherein each one of the rotary keys has a fixing leg and each one of the idler gears has an index pocket, each one of the fixing legs received in one of the index pockets prior to engagement of the idler gear with the timing gear, and wherein each one of the rotary keys has a pushing leg which is in contact with one of the idler gears when the rotary key is rotated.

16. The pushbutton lock combination chamber of claim 15 wherein each one of the biasing members is a spring attached to one of the rotary keys and to the rotary key guide.

17. The pushbutton lock combination chamber of claim 16 further comprising a rotation indexer engaged with the timing gear at predetermined angular locations which defines incremental rotations of the timing gear.

18. A method of unlocking a lock combination chamber comprising the steps of:

rotating a plurality of rotary keys mounted on a timing gear and rotatable relative thereto in a predetermined sequence;

rotating a plurality of idler gears by contacting each idler gear with one of the rotating rotary keys;

engaging each idler gear with the timing gear and rotating the timing gear by rotating each of the idler gears;

rotating a plurality of code gears in which each code gear is engaged with one of the idler gears by rotating the idler gears;

positioning a pocket on each of the code gears at a predetermined location by rotation of the code gears; and sliding an unlocking slide having a plurality of legs and inserting each of the legs into one of the pockets on the code gears to unlock the combination chamber.

19. The method of claim 18 wherein the steps of rotating a plurality of rotary keys and rotating a plurality of idler gears further comprises the steps of:

removing a fixing leg on each of the rotary keys from an index pocket on each of the idler gears;

contacting a pushing leg on each of the rotary keys with a key contact area on each of the idler gears; and rotating each of the idler gears by pushing on each of the idler gears with each of the pushing legs.

20. The method of claim 18 wherein the unlocked combination chamber is reset by comprising the further steps of:

removing the legs of the unlocking slide by sliding the unlocking slide;

rotating a reset cam connected to the timing gear;

rotating the timing gear to a starting position by rotating the reset cam;

rotating the idler gears by rotating the timing gear; and rotating the code gears by rotating the idler gears.

21. The method of claim 18 wherein the predetermined sequence in the step of rotating a plurality of rotary keys is determined by the method comprising the steps of:

aligning each of the pockets on the code gears with one of the legs on the unlocking slide;

disengaging each of the code gears from the idler gears by moving each of the code gears so that each of the pockets on the code gears receives one of the legs on the unlocking slide;

rotating the rotary keys in a desired unlocking sequence;

rotating the idler gears by contacting each idler gear with one of the rotating rotary keys;

engaging each idler gear with the timing gear and rotating the timing gear by rotating each of the idler gears;

engaging each of the code gears with one of the idler gears by moving each of the code gears so that the pockets on the code gears are spaced apart from the legs on the unlocking slide;

rotating a reset cam connected to the timing gear;

rotating the timing gear to a starting position by rotating the reset cam;

rotating the idler gears by rotating the timing gear; and rotating the code gears by rotating the idler gears.

22. A method of unlocking a lock combination chamber comprising the steps of:

rotating a plurality of rotary keys mounted on a timing gear in a predetermined sequence;

rotating a plurality of idler gears by contacting each idler gear with one of the rotating rotary keys;

engaging each idler gear with the timing gear and rotating the timing gear by rotating each of the idler gears;

rotating a plurality of code gears in which each code gear is engaged with one of the idler gears by rotating the idler gears;

positioning a pocket on each of the code gears at a predetermined location by rotation of the code gears; and sliding an unlocking slide having a plurality of legs and inserting each of the legs into one of the pockets on the code gears to unlock the combination chamber;

wherein the steps of rotating a plurality of rotary keys and rotating a plurality of idler gears further comprises the steps of:

removing a fixing leg on each of the rotary keys from an index pocket on each of the idler gears;

contacting a pushing leg on each of the rotary keys with a key contact area on each of the idler gears; and rotating each of the idler gears by pushing on each of the idler gears with each of the pushing legs.

* * * * *